United States Patent [19]

Alkema

[11] 4,176,885

[45] Dec. 4, 1979

[54] HOPPER VESSEL WITH DISCHARGE VALVE MEMBERS ADAPTED TO SELECTIVELY FUNCTION AS PART OF A DISCHARGE CONDUIT

[75] Inventor: Jan Alkema, Pijnacker, Netherlands

[73] Assignee: Koninklijke Adriaan Volker Baggermaatschappij B.V., Netherlands

[21] Appl. No.: 844,143

[22] Filed: Oct. 20, 1977

[51] Int. Cl.[2] ..... B65G 53/30

[52] U.S. Cl. ..... 406/128; 114/27

[58] Field of Search ..... 302/14, 15, 27, 51, 302/57; 214/14, 15 B; 114/26, 27

[56] References Cited

U.S. PATENT DOCUMENTS 2,693,282 11/1954 Sensibar ..... 302/15 X

FOREIGN PATENT DOCUMENTS 154022 10/1901 Fed. Rep. of Germany .
151765 6/1903 Fed. Rep. of Germany .
213798 9/1907 Fed. Rep. of Germany .
665714 9/1937 Fed. Rep. of Germany .
884778 7/1949 Fed. Rep. of Germany .
7311494 8/1973 Netherlands .
14591 of 1915 United Kingdom .

*Primary Examiner*—Robert B. Reeves
*Assistant Examiner*—James L. Rowland

[57] ABSTRACT

A hopper vessel has a series of discharge valve members in the bottom, which valve members can swing about a transverse axis from a horizontal postion, in which they close the bottom openings of the hold of the vessel, into a vertical position, in which they fully open said bottom openings, which valve members also can be placed in an inclined intermediate position in which they still close the bottom openings, said valve members being provided with channels which are in line with channels in the intermediate parts of the bottom and with a conduit connected to a pump, and the bottom openings, at the level of the valve members, having openings in the side walls connecting to water supply which openings are closed in the horizontal position of the valve members by said valve members and opened in the intermediate position whereby water entering through the openings assists in the discharge of material through the conduit with at least one valve member in said intermediate position.

9 Claims, 2 Drawing Figures

HOPPER VESSEL WITH DISCHARGE VALVE MEMBERS ADAPTED TO SELECTIVELY FUNCTION AS PART OF A DISCHARGE CONDUIT

The invention relates to a hopper or such like vessel, provided with a row of discharge valve members mounted to rotate around a horizontal axis in the bottom of the hold and with means to operate these valve members and further provided with a suction conduit with a water inlet at one end and a pump at the other end, as well as with inlet openings for the material which has to be discharged and which openings can be shut off, by means of which suction conduit the hold can be discharged when the valve members are closed because the suction conduit is formed by aligned channels in the discharge valve members and in the bottom parts of the hold lying between them.

Such a hopper is known from the German Pat. No. 154,022. In this known hopper the discharge valve members are mounted to rotate around shafts extending parallel to the longitudinal axis of the vessel. They are operated by means of chains extending through the hold and so through the cargo. Further separate valve members are present in the bottom parts lying between the discharge valve members and providing the interconnection between the hold and the suction conduit. These also are operated by means of chains. Such operating elements extending through the cargo can easily be damaged during discharge.

The object of the invention is to provide a hopper or such like vessel which without special arrangements is suitable for being discharged via the discharge valve members in the bottom and for being discharged by sucking off with the bottom valve members closed which last mentioned means do not interfere with the discharge via the valve members while it is no longer required that the operating means are extending through the cargo.

According to the invention this object is obtained by the fact that each valve member rotates around an axis transverse to the longitudinal axis of the vessel and that each valve member can be brought into an inclined position in which the bottom opening is still closed but in which the channel in the relating valve member, at the side directed to the pump, is no longer connected to the channel in the adjacent bottom part, which valve member in this inclined position has made free another water supply opening through which by means of the suction conduit water can be sucked in.

So the discharge valves in the bottom now have a double function. When they are swung from the closed position to the open position then the discharge takes place in the normal way via these valve members. When a bottom valve member is brought into a position in which indeed the member is still closing the opening but in which the connection via the channel extending through the valve member is cut off then water will be sucked in via the remaining operative part of the suction conduit through the openings which are made free by the somewhat removed valve member such that a sucking off may take place of the cargo present above the somewhat displaced valve member.

The valve members can be constructed as a box and can be positioned in a valve housing with openings in the side walls which are controlled by the box shaped valve member and which themselves communicate with the surrounding water.

In the usual way the valve members can be pivotally mounted to a shaft parallel to the longitudinal axis of the vessel. According to the invention, however, it is advantageous to have the valve members pivotally mounted to a horizontal cross shaft such that it is possible to use hydraulic cylinders for operating them which may be accommodated in the space beside the hold.

When the shafts to which the valve members are pivotally mounted are situated near the rear end of the valve members then a very effective discharge via the discharge valves may be obtained. For as soon as one or more of the valve members are brought into the open position a strong flow will occur in the direction to the hold when, as usual, the vessel still has some velocity. On the one side then the valve members are working as brake valves and on the other side as flow guidings so that the flow entering the opened hold section from the bottom will stir and loosen the cargo which is present there.

The contents of the hold can be divided into comartments by means of transverse partitions, each compartment having one or more bottom valve members. Then it can be of help to make these partitions removable because then use can be made of a longer slope during discharge via the suction conduit, in which the valve members are simultaneously brought in the position suitable for this. The same can be obtained when the partitions are pivotally mounted to a horizontal shaft positioned near an upper edge. In the locked position such a partition may act as a partition; in the unlocked position, however, it may swing to a position by which the discharge is promoted.

Now the invention will be further described by means of the drawings.

Figure 1:
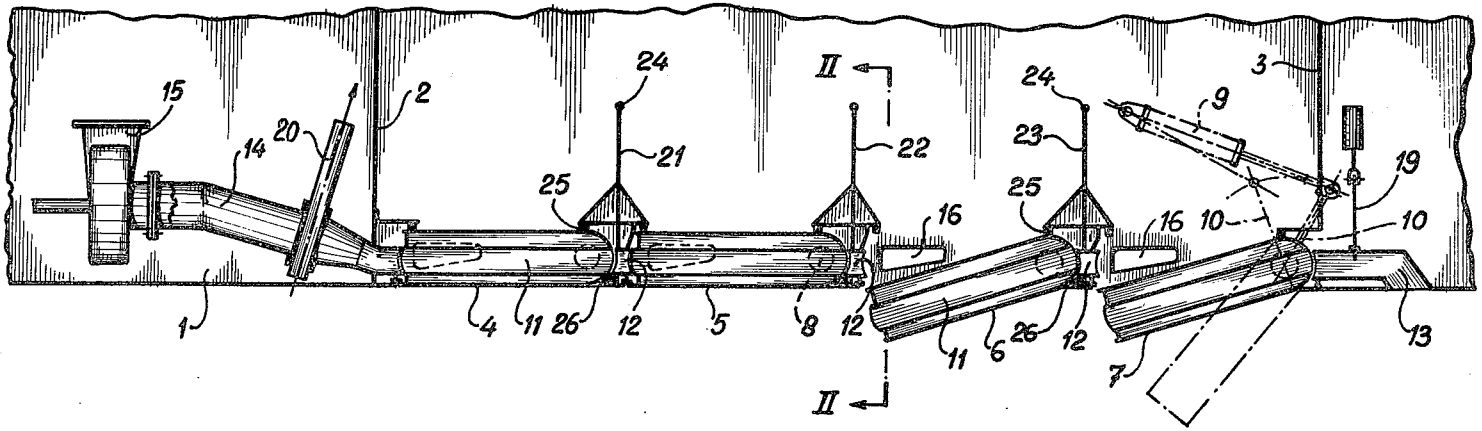
FIG. 1 shows a longitudinal section through the bottom part of a hopper.
Figure 2:
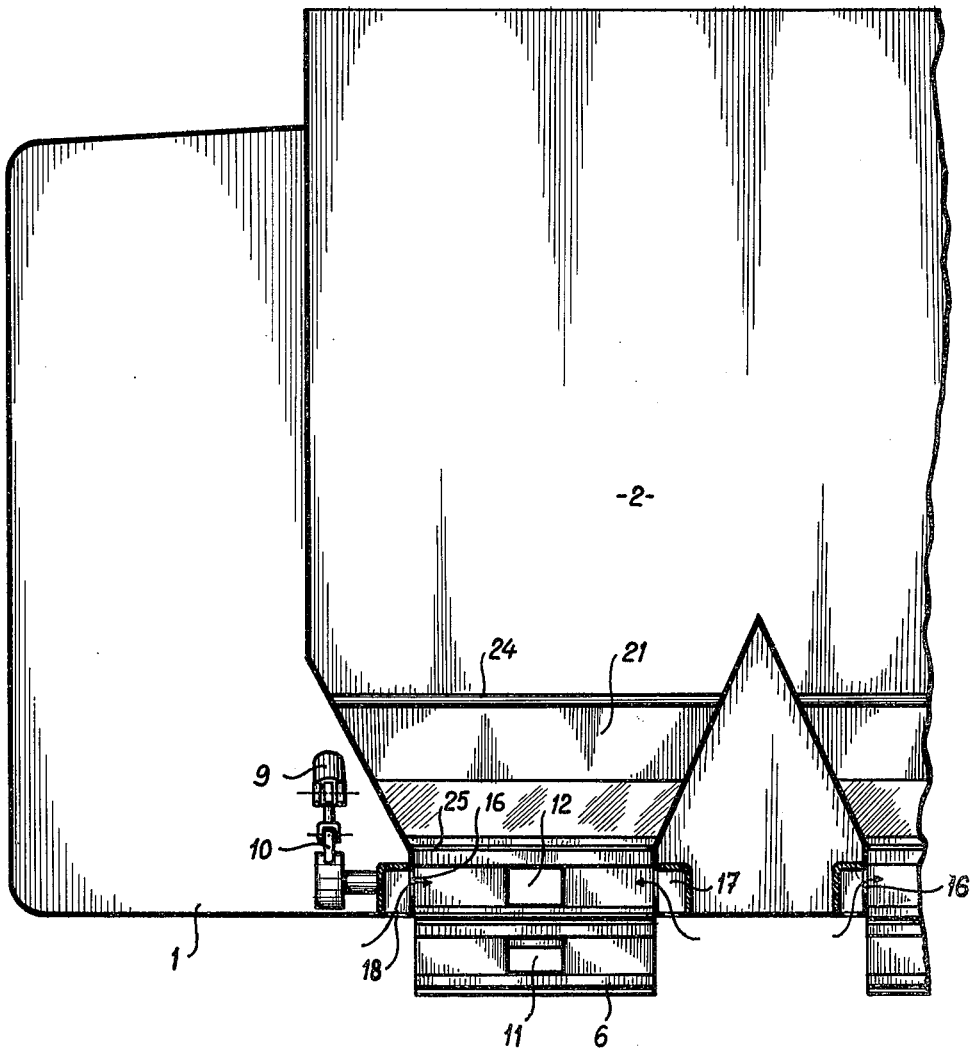
FIG. 2 is a section according to the line II—II of FIG. 1.

The hopper shown in the drawing has a bottom 1. The hold has end walls 2 and 3 and the bottom consisting of box-shaped sections has a number of valve members 4–7 which are pivotally mounted to shafts 8 near the rear wall and can be operated by means of a schematically shown hydraulic cylinder 9 through a lever 10.

Through each valve member a channel 11 is provided co-operating with channels 12 in the remaining bottom parts of the vessel. The channels 11 and 12, together with the inlet conduit 13 and the suction channel 14 with pump 15, form a suction conduit by means of which the hold can be discharged when the valve members are in the closed position and at least one valve member is brought into the nearly open position as indicated in case of the valve members 6 and 7.

In the position in which the valve members 4 and 5 are shown each box-shaped valve member will close inlet openings 16 by the side of it. These openings form the mouth of a space 17 which itself is connected to the surrounding water via the opening 18.

When a valve member is brought into the position shown for the valve members 6 and 7 then the channel 11 will no longer be connected to the channel 12 however the openings 16 are set free such that water will flow in from the side through the openings 18 and 16 and the cargo which is sinking down will be taken along and will be discharged by means of the pump 15 through the suction conduit.

When it is not needed to use this conduit then this can be closed by means of the valves 19 and 20 and the valve members 4–7 can be fully opened so that the discharge can take place through these valve members.

As shown the hold is divided into sections by the partitions 21, 22, 23. These can be constructed such that they are upwardly removable or they can be pivotally mounted to a horizontal axis which has to be situated at the edge 24.

The sealing of each bottom valve member can be obtained in a simple manner by means of a circumferential rubber rim 25 at the upper side and by means of a rubber lip 26 against the bended part.

I claim:

1. A hopper vessel comprising: a hold having a series of discharge openings in the bottom thereof, a series of valve members mounted for rotation to open and close said discharge openings, said valve members extending horizontally in their closed positions, and a suction conduit having a suction pump at one end and an inlet at the other end, said conduit comprising in part aligned channels through said valve members, characterized in that each valve member is mounted for rotation about a horizontal pivot axis extending transversely of the longitudinal axis of said vessel, said valve members and said conduit in part formed thereby are aligned generally parallel to the longitudinal axis of said vessel, said hold further comprises water supply openings and said valve members are arranged to close said supply openings in the closed position of said valve members, each said valve member is rotatable to an intermediate position thereof inclined to the horizontal in which said discharge opening thereat is closed, said water supply openings thereat are open, said channel therein is disconnected from said conduit and said conduit thereadjacent, in the direction toward said pump, is open to the portion of said hold at said valve member rotated to said intermediate position whereby cargo in said hold may be discharged through said conduit.

2. A hopper vessel according to claim 1, characterized in that the valve members are constructed as a box the edge of each of which is semi-cylindrically shaped concentric with said pivot axis thereof.

3. A hopper vessel according to claim 1, characterized in that with each valve member the supply openings associated with each valve member are positioned in the side walls of a valve member housing and that these supply openings are connected to secondary water inlet openings in the bottom of the vessel lying by the side of the valve member.

4. A hopper vessel according to claim 3, characterized in that box-shaped spaces are present by both sides of each valve member in the walls of which the secondary water inlet and the supply openings are situated.

5. A hopper vessel according to claim 1, characterized in that the valve members are pivotally mounted to a horizontal cross shaft.

6. A hopper vessel according to claim 5, characterized in that the shafts to which the valve members are pivotally mounted are situated near the rear end of the valve members as seen in the normal direction of movement of the vessel.

7. A hopper vessel according to claim 1, characterized in that the hold is divided into sections by means of transverse partitions positioned between the valve members.

8. A hopper vessel according to claim 7, characterized in that said partitions are removable.

9. A hopper vessel according to claim 7, characterized in that said partitions are pivotally mounted to a horizontal shaft near their upper edge.

* * * * *